US011276269B2

(12) United States Patent
Pellegrini et al.

(10) Patent No.: US 11,276,269 B2
(45) **Date of Patent: *Mar. 15, 2022**

(54) AMUSEMENT GAME MACHINE AND METHOD OF PLAY HAVING A TRANSMISSIVE ELECTRONIC DISPLAY PANEL OVERLYING PLAY FIELD

(71) Applicants: Ed Pellegrini, Elk Grove Village, IL (US); Kenneth J. Fedesna, Elk Grove Village, IL (US); Dirty Dog Gaming, Inc., Yorkville, IL (US)

(72) Inventors: Ed Pellegrini, Palatine, IL (US); Kenneth J. Fedesna, Hawthorn Woods, IL (US); Frank Pellegrini, Yorkville, IL (US); Brian Smolik, Naperville, IL (US); Joe Cicak, Harrisburg, PA (US); Bobby Llereza, Aurora, IL (US)

(73) Assignees: Frank J. Pellegrini, Yorkville, IL (US); Kenneth J. Fedesna, Yorkville, IL (US); Dirty Dog Gaming, Inc., Yorkville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/572,273

(22) Filed: Sep. 16, 2019

(65) Prior Publication Data

US 2020/0013256 A1 Jan. 9, 2020

Related U.S. Application Data

(63) Continuation of application No. 14/880,831, filed on Oct. 12, 2015, now Pat. No. 10,445,972.

(Continued)

(51) Int. Cl.
*G07F 17/32* (2006.01)

(52) U.S. Cl.
CPC ..... *G07F 17/3211* (2013.01); *G07F 17/3209* (2013.01); *G07F 17/3216* (2013.01); *G07F 17/3218* (2013.01); *G07F 17/3244* (2013.01)

(58) Field of Classification Search
CPC ..... G07F 17/3211; G07F 17/3209; G07F 17/3216; G07F 17/3218; G07F 17/3244
See application file for complete search history.

(56) References Cited

U.S. PATENT DOCUMENTS 4,496,160 A 1/1985 Wichinsky et al.
5,120,060 A 6/1992 Parker et al.
(Continued)

FOREIGN PATENT DOCUMENTS

JP 2006102476 A * 4/2006
JP 2006102476 A 4/2006

OTHER PUBLICATIONS

IT#4 How to play Pachinko https://www.youtube.com/watch?v=0tRcIMW6YqQ Uploaded by CSUSB102W09 Mar. 9, 2009 (Year: 2009).*

*Primary Examiner* — Tramar Harper
*Assistant Examiner* — Jeffrey K Wong
(74) *Attorney, Agent, or Firm* — Levenfeld Pearlstein, LLC

(57) ABSTRACT

A game machine featuring a play field, a light source and a transmissive electronic display covering at least a portion of the play field. The play field having a top and bottom and a translucent back panel having first and second sides. The back panel being located between the play field and the light source. The play field located between the back panel and the electronic display. The light source illuminating the electronic display through the back panel to present images over the play field.

20 Claims, 17 Drawing Sheets

Related U.S. Application Data

(60) Provisional application No. 62/062,552, filed on Oct. 10, 2014.

(56) References Cited

U.S. PATENT DOCUMENTS

| | | | | |
|---|---|---|---|---|
| 5,301,942 | A | 7/1994 | Lacrosse | |
| 5,501,466 | A | 3/1996 | Welch et al. | |
| 6,047,963 | A | 4/2000 | Pierce et al. | |
| 8,256,770 | B1 * | 9/2012 | Mousa | G07F 17/38 273/138.3 |
| 2002/0036825 | A1 * | 3/2002 | Lipton | H04N 13/305 359/463 |
| 2002/0094856 | A1 * | 7/2002 | Bennett | G07F 17/34 463/16 |
| 2003/0073479 | A1 * | 4/2003 | Wilson | G07F 17/3213 463/16 |
| 2010/0004059 | A1 * | 1/2010 | Kopera | G07F 17/3211 463/30 |
| 2013/0053123 | A1 * | 2/2013 | Nicely | G07F 17/3209 463/20 |
| 2013/0181399 | A1 | 7/2013 | Stellenberg et al. | |
| 2014/0091519 | A1 | 4/2014 | Gomez | |
| 2014/0106855 | A1 | 4/2014 | Lachance et al. | |

* cited by examiner

AMUSEMENT GAME MACHINE AND METHOD OF PLAY HAVING A TRANSMISSIVE ELECTRONIC DISPLAY PANEL OVERLYING PLAY FIELD

CROSS REFERENCE TO RELATED APPLICATION

This application is a continuation of and claims priority to U.S. patent application Ser. No. 14/880,831 filed Oct. 12, 2015, now allowed, which claims the benefit of U.S. Provisional Patent Application Ser. No. 62/062,552 filed Oct. 10, 2014, the entirety of these applications are hereby incorporated by reference as if fully set forth herein.

FIELD

Embodiments of the subject invention pertain generally to an amusement game machine, and more particularly to an electromechanical game machine or apparatus having a transmissive electronic display positioned in front of, or incorporated into, a mechanical play field.

BACKGROUND

Electromechanical amusement game machines are generally well-known and have been relatively popular for a number of years. Such machines can be constructed in numerous different styles and formats and can provide a variety of different types of games, including for example, games of skill and/or games combining elements of both skill and chance. Examples of such games can include ticket and/or prize redemption games, coin-operated games and pinball-type games.

Typically, such amusement machines can include an exterior cabinet or housing with an enclosed play field that can be viewed through a transparent window at the front of the machine. During play of the game, the player can manipulate or actuate a play piece, such as a ball, disk, token, coin or pellet into the play field, and depending on the configuration of the game, can accumulate points, credits or awards based on the rules and format of the game.

Amusement game machines can be commonly found at entertainment or amusement venues, including amusement arcades, carnivals, restaurants and bars, amusement parks and movie theaters. Typically, such games are revenue-producing for the game operator and/or owner and require payment to play. Thus, in instances where a game is unpopular or player interest in the game wanes, play is likely to be intermittent or infrequent, resulting in games being inactive for extended periods of time and loss of potential revenue. Thus, game developers and owners/operators are continually in need of new game concepts or features to generate and maintain player interest.

DETAILED DESCRIPTION

Figure 1:
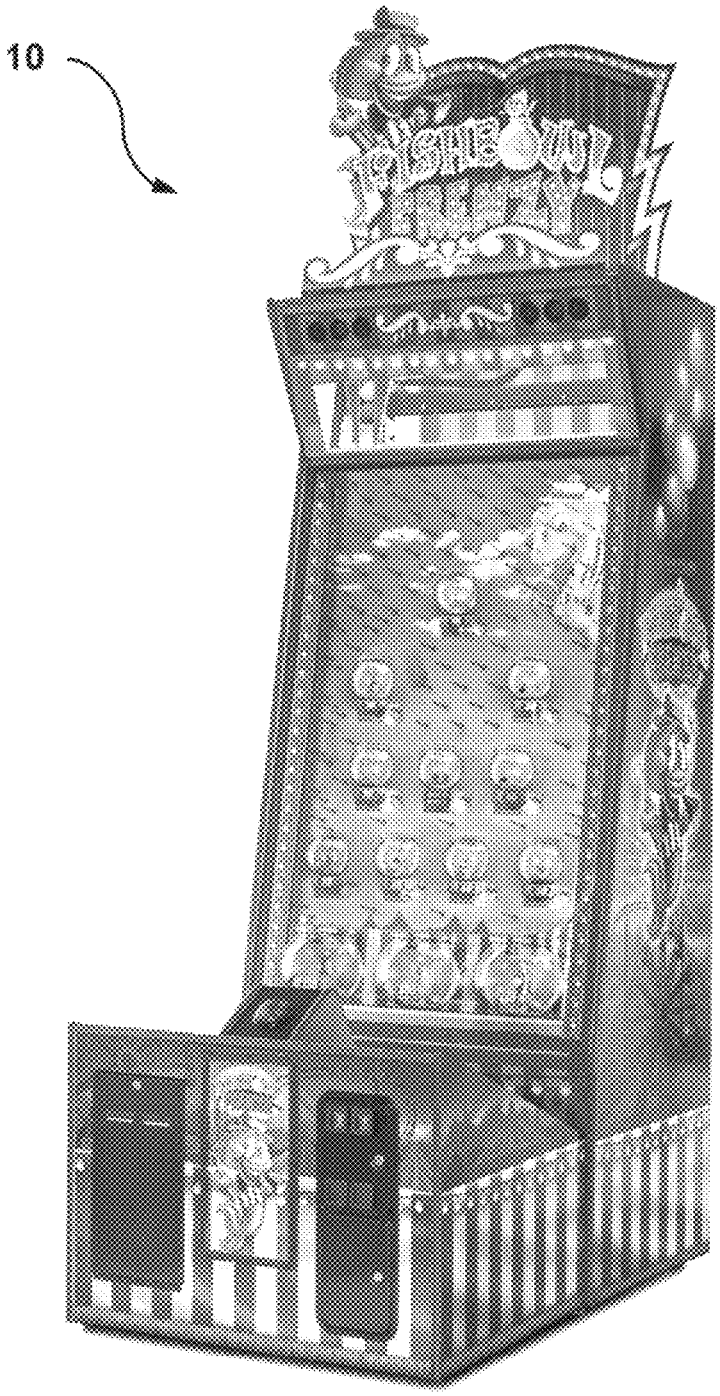
FIG. 1 is a first perspective view of a game machine according to embodiments presented herein.
Figure 2:
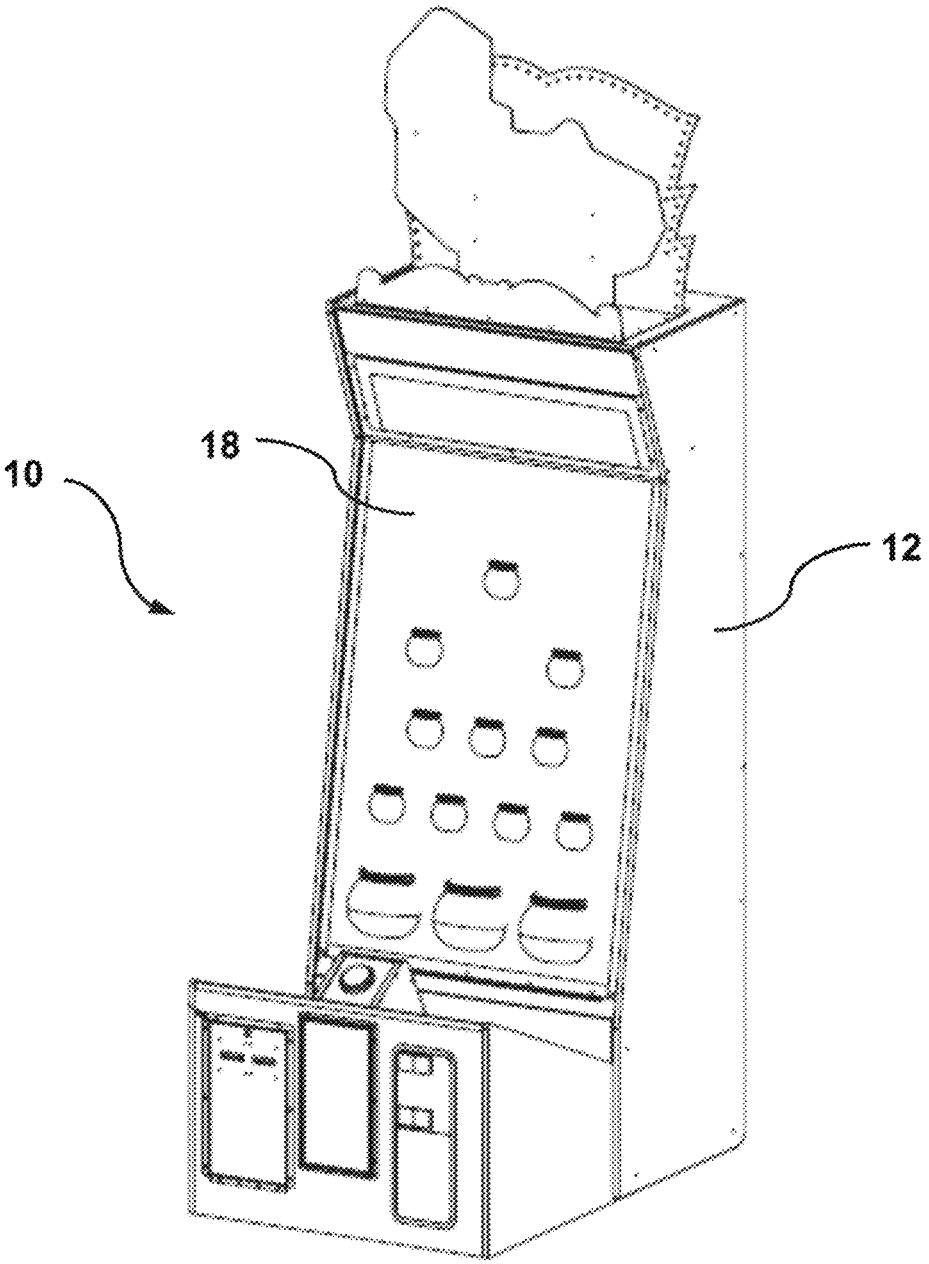
FIG. 2 is second perspective view of a game machine according to embodiments presented herein.
Figure 3:
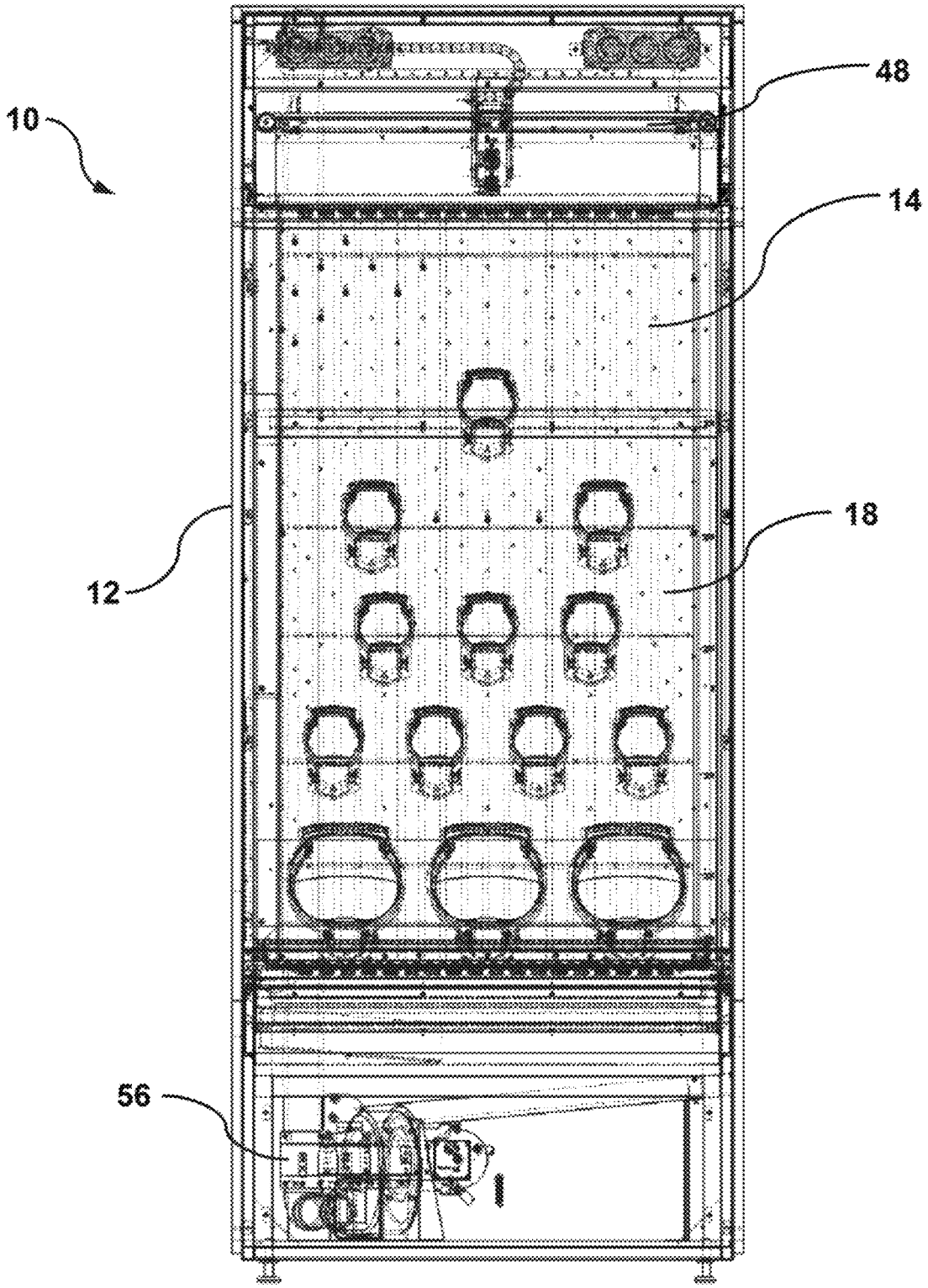
FIG. 3 is a cross-sectional front elevation view of the game machine.
Figure 4:
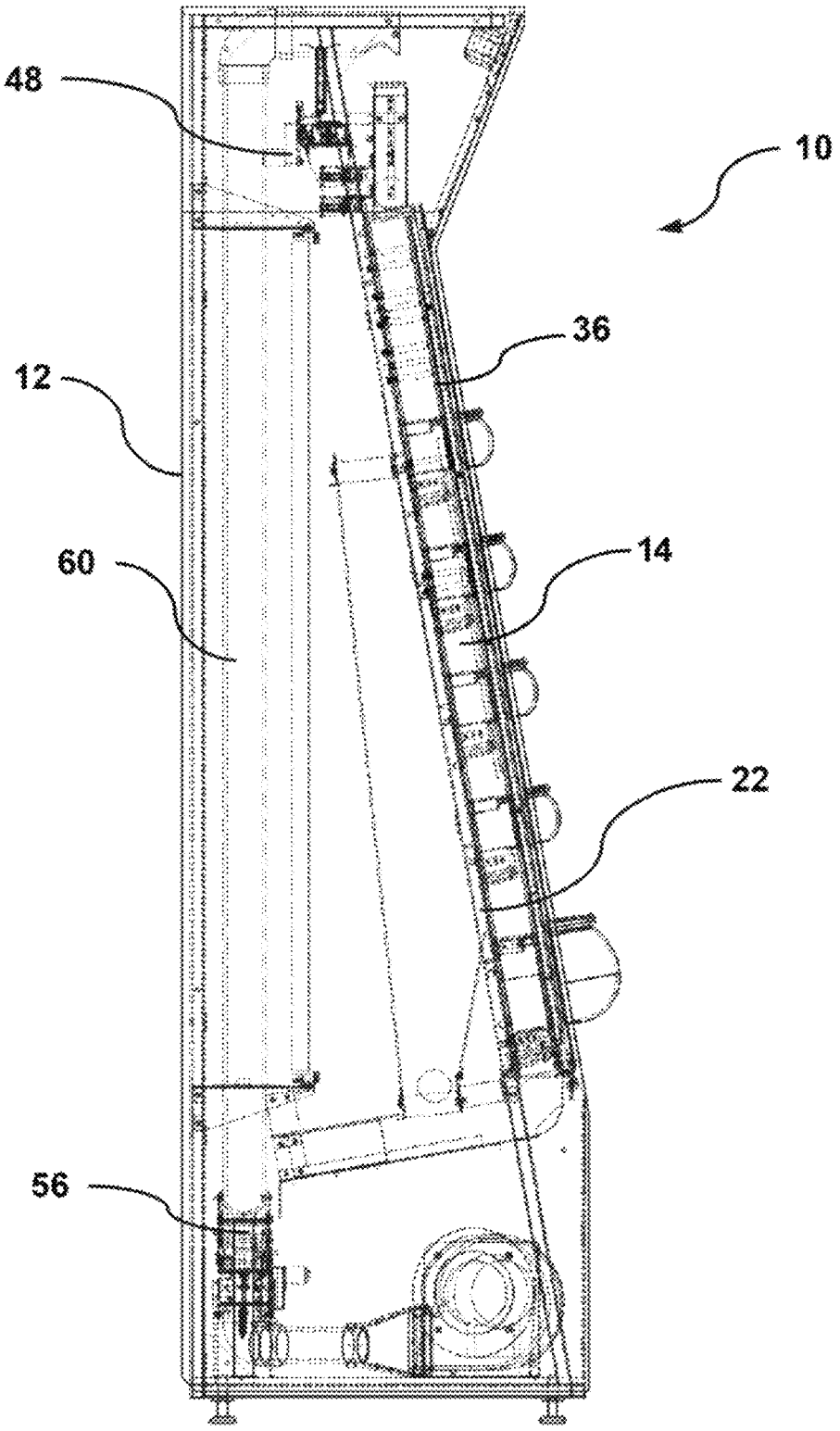
FIG. 4 is a cross-sectional side elevation view of the game machine.
Figure 5:
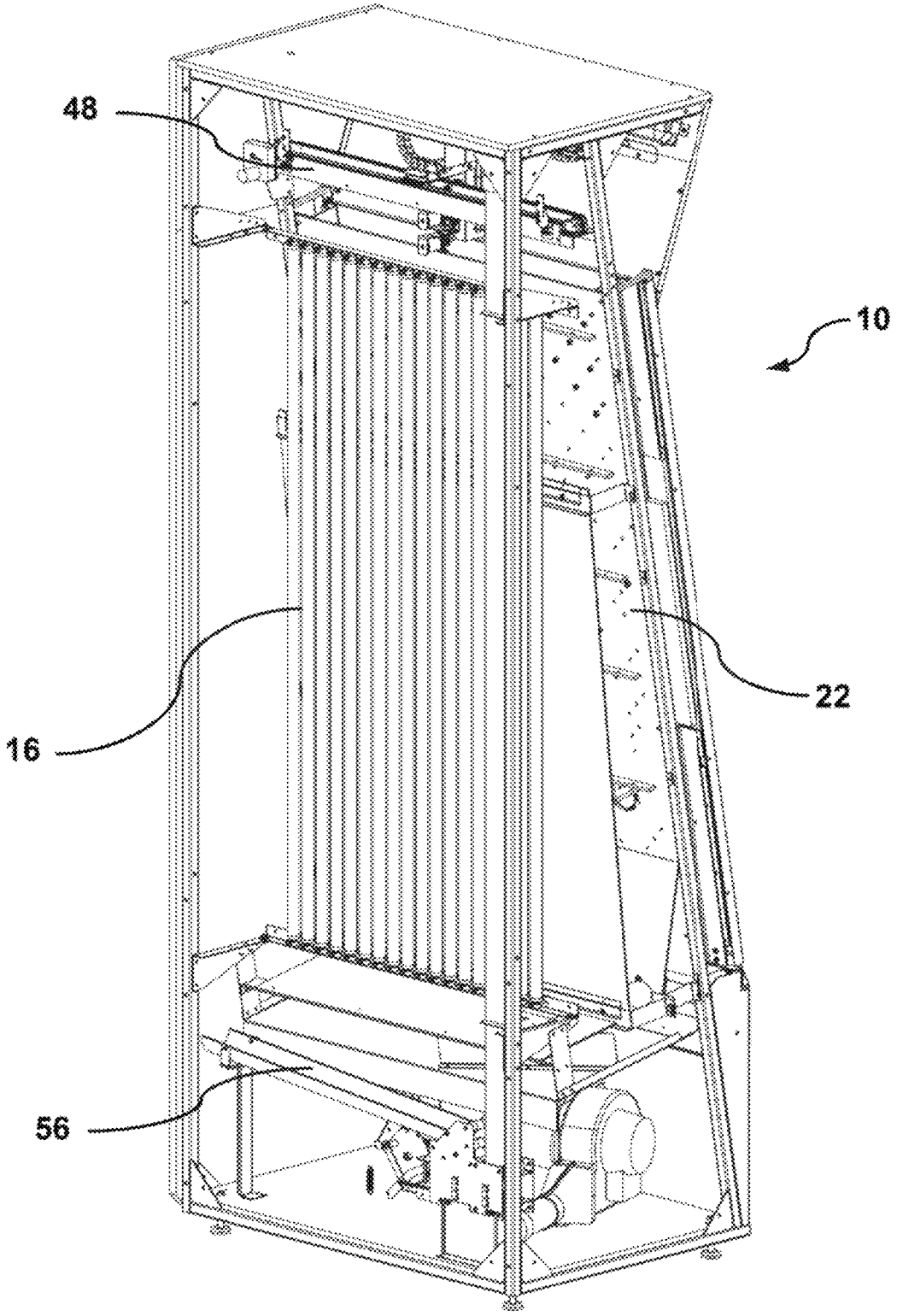
FIG. 5 is a rear perspective view of the game machine with the rear and side panels of the cabinet removed.

While the subject invention is susceptible of embodiment in many different forms, there are shown in the drawings, and will be described in detail herein, specific embodiments thereof with the understanding that the present disclosure is to be considered as an exemplification of the principles of the invention and is not intended to limit the invention to the specific embodiments illustrated.

With reference now to the figures, FIGS. 1 through 6 illustrate an exemplary embodiment of a game machine 10 according to the subject invention. According to such embodiments, the game machine 10 can comprise an external cabinet 12 housing a play field 14 and a light source 16 located behind the play field 14. The machine can additionally feature a substantially transparent window 18 along the front of the machine 10 with a transmissive electronic display 20. The electronic display 20 can cover all or a portion of the play field 14.

According to embodiments presented herein, the electronic display 20 can be a substantially flat panel display unit such as, for example, a translucent flat panel liquid crystal display ("LCD"). The electronic display 20 can be illuminated by the light source 16 located behind the play field 14 to display or present fixed or dynamic images, video or graphics. Since the electronic display 20 is positioned in front of the play field 14 in a player's line of sight, images displayed on the electronic display 20 can appear superimposed over the play field 14. Thus, the electronic display 20 can be controlled to display game imagery, including interactive graphics, scores, prizes, bonus information or other game notifications as further described below. As exemplified herein, such imagery can virtually interact and/or visually supplement mechanical play elements in the play field to create an augmented reality game play for the player. It will be recognized and understood that such augmented game play can provide a more interactive game experience by virtually enhancing and/or transforming the appearance of the play field and/or in-game activities.

The play field 14 can be configured for playing a game of skill, and/or game combining elements of both skill and chance. For exemplary purposes, embodiments disclosed herein will be described in connection with a game and game machine 10 having a substantially vertically-oriented play field 14; however, it will be understood by persons of ordinary skill in the art that the subject invention is not limited to use in connection with such games specifically, and can be used in connection with any type of game involving mechanical or electromechanical operations.

The play field 14 of machine 10 can include a back panel 22 having a plurality of deflection members 24, such as for example, pins, pegs, ridges or raised shapes extending from an interior face of the panel 22. The deflection members 24 can be static fixtures or can move inside the play field 14, or have portions or pieces that move. Where portions of the members 24 are moveable, such movement can be consistent or can be intermittent as desired. Such movement can additionally be controlled by an electrical or electro-mechanical device, such as for example, a motor, solenoid, gear or pulley, or can be actuated by contact from a play piece descending through the play field 14.

The back panel 22 can be comprised of a translucent or semi-translucent material which can allow light to pass therethrough. The light source 16 can be located behind the panel 22 opposite the play field 14 and transmissive electronic display 20. The light source 16 can include any kind of electric lamp or lighting element, including for example, light emitting diodes (LEDs), fluorescent, neon, halogen, incandescent or compact fluorescent lights. Thus, illumination from light source 16 can pass through the back panel 22 to illuminate the play field 14 and the electronic display 20. The back panel 22 can additionally include transparent stand-offs so that electrical wiring is not illuminated by the backlighting and does not otherwise interfere with the lighting effects or cause undesired shadows across the play field 14.

Figure 7A:
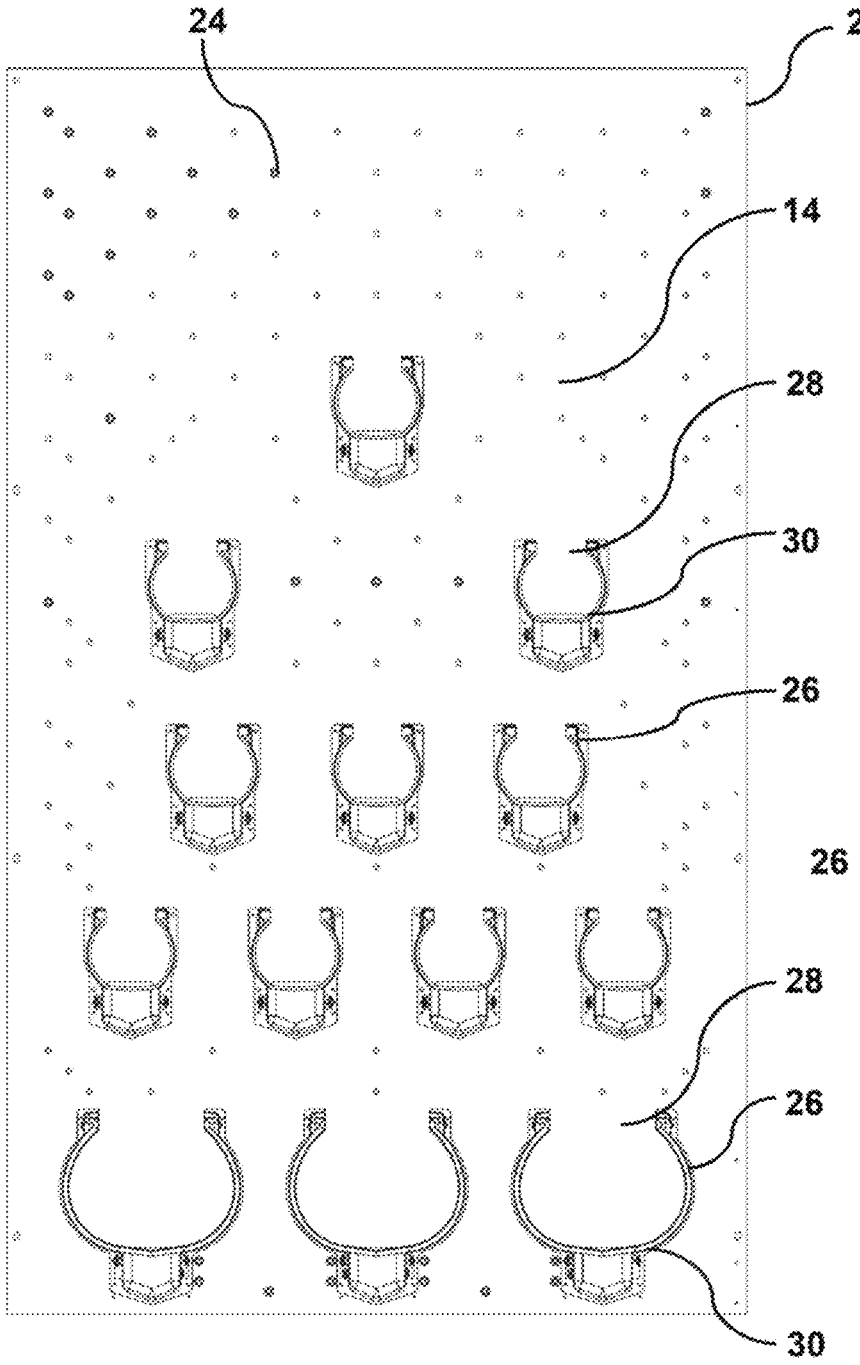
FIG. 7A is a front elevation view of a play field according to embodiments presented herein.
Figure 7B:
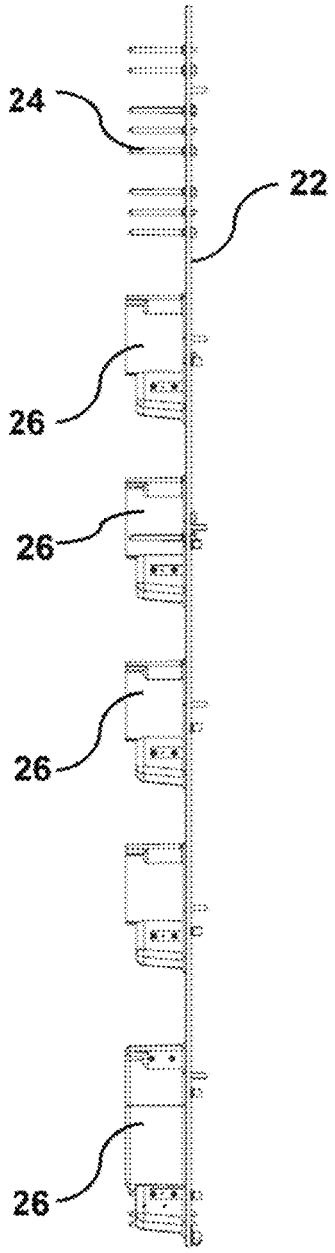
FIG. 7B is a side elevation view of the play field illustrated in FIG. 7A.
Figure 7C:
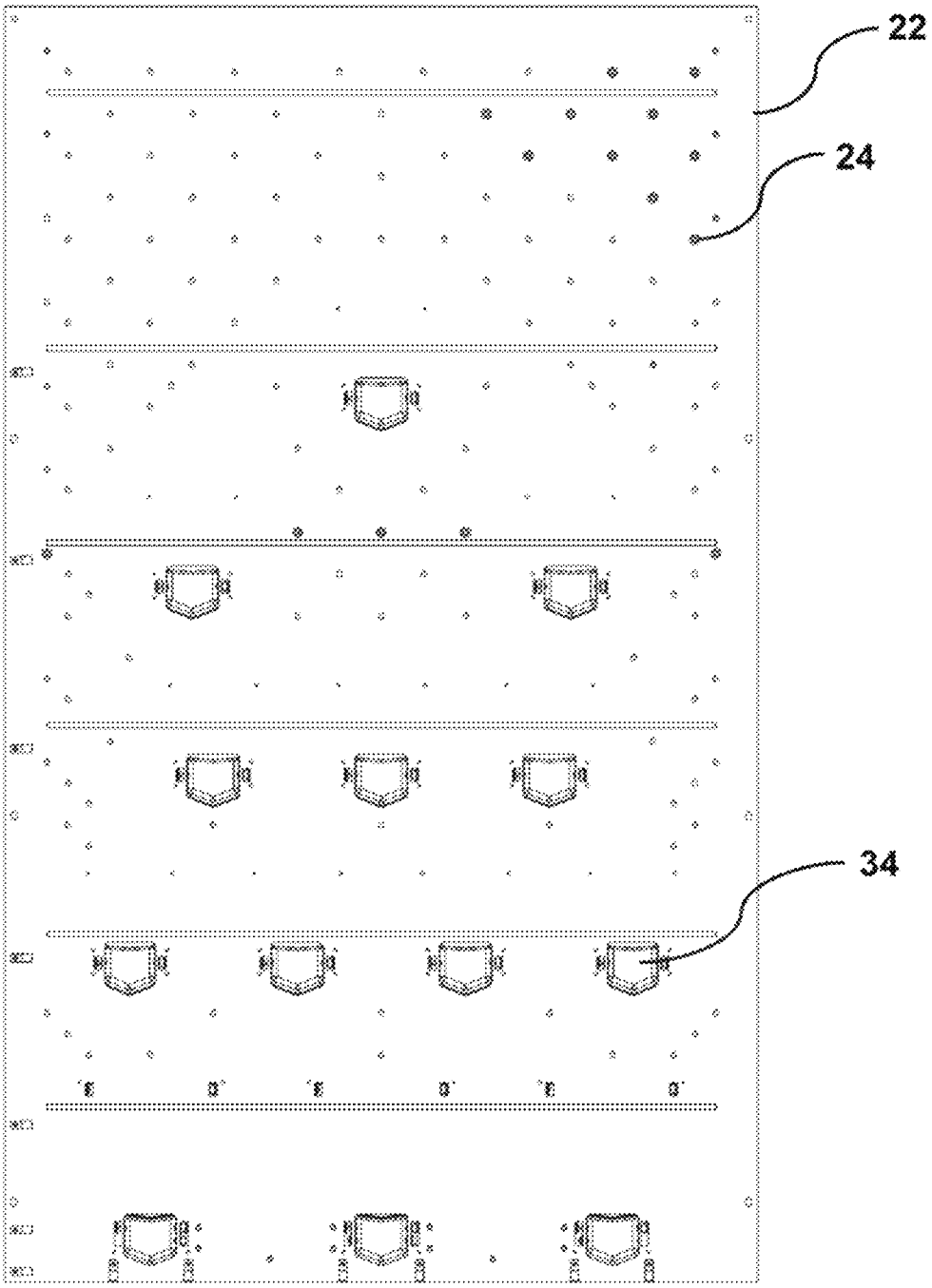
FIG. 7C is a front elevation view of a back panel of the play field illustrated in FIG. 7A.

FIGS. 7A-7C illustrate exemplary embodiments of the play field 14 and back panel 22. Back panel 22 can be substantially planar or can have a curved surface and can be positioned in an upright arrangement or at an angle such that a play piece is able to slide, roll or otherwise descend down the interior face of the panel 22 from the top to the bottom under the force of gravity. During play of such a game, a play piece, such as a ball, disk, coin, token or pellet can move through the play field 14 between the deflection members 24. Thus, as is generally known, when released near the top of the play field 14, the game piece can be continuously deflected by the deflection members 22 which can direct the piece to fall into, or through, particular areas or locations on the play field 14.

It will be recognized and understood by persons of ordinary skill in the art that the play pieces used with the subject machine 10 can be any kind of ball, disk, coin, token, pellet or other article that can roll, spin, bounce or that is otherwise capable of falling through the play field between the pins or deflection members 24. For example, play pieces according to one embodiment can include commercially available racquetball balls having a hollow interior with a rubber composite shell.

The play field 14 can additionally feature one or more receptacles 26, such as for example, bowls, cups, brackets or V or U-shaped members positioned at various locations inside the play field 14 along the interior face of panel 22. Such receptacles 26 can be configured to catch or receive play pieces falling through the play field.

Figure 8A:
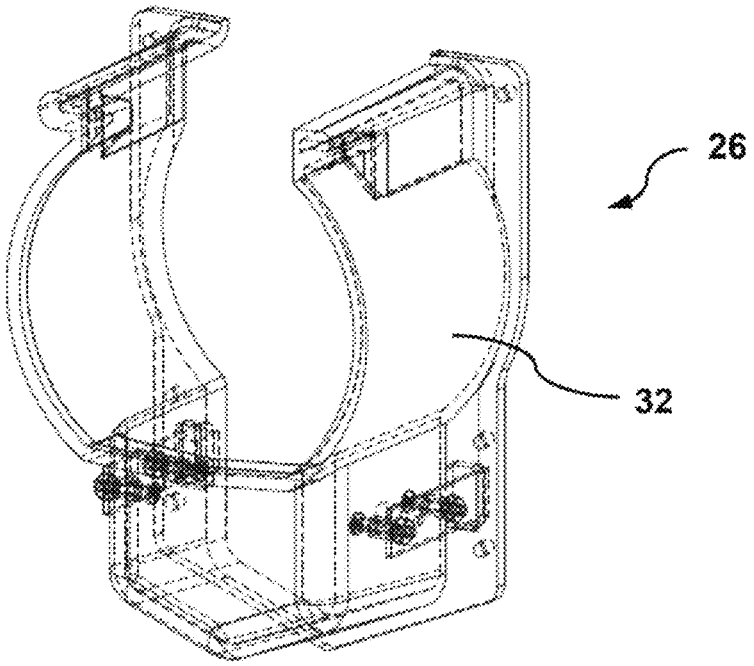
FIG. 8A is a perspective view of a receptacle according to embodiments presented herein.
Figure 8B:
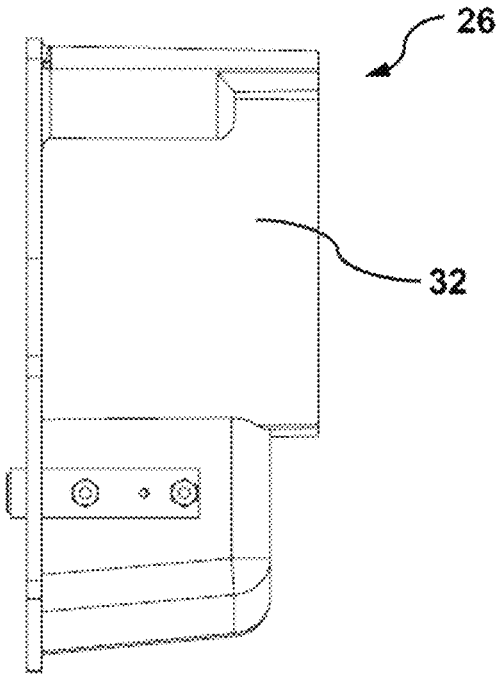
FIG. 8B is a side elevation view of the receptacle illustrated in FIG. 8A.
Figure 8C:
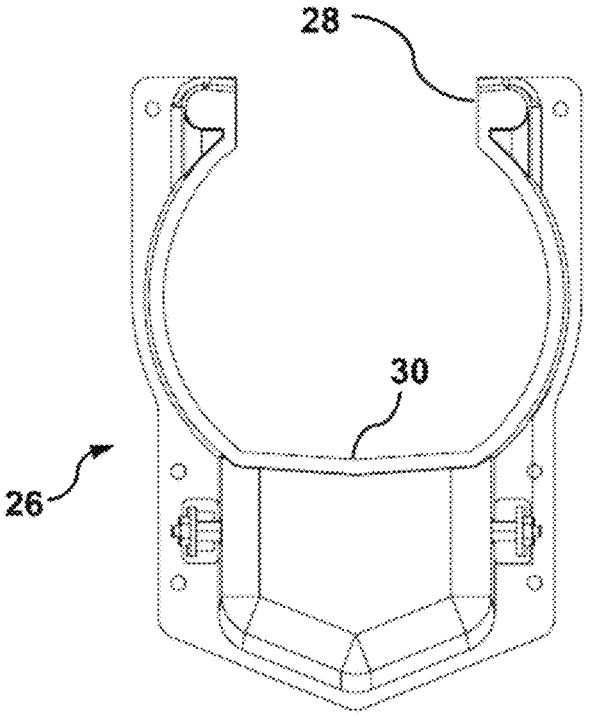
FIG. 8C is a front elevation view of the receptacle illustrated in FIG. 8A.

FIGS. 8A-8C illustrate an exemplary receptacle 26 according to embodiments set forth herein. Generally, receptacle 26 can include an open upper end 28 which can allow the play piece to enter the receptacle 26 from above and a partially closed bottom end 30. Receptacle 26 can additionally feature side walls 32 between the open and closed ends 28, 20 or along at least a portion of the front of the receptacle opposite the back panel 22. Receptacle 26 can be positioned over a door or flap 34 on the back panel 22 which can allow play pieces to pass though the panel 22 to exit the play field 14. Alternatively, the play pieces can exit the play field through the bottom of the play field 14 or through other devices such as spinners.

Receptacles 26 can additionally include sensors, such as an opto or photo-electric sensor, or switches such as a micro-switch or other type of mechanical switch. Such sensors can be located, for example, proximate the upper opening 28, around the interior portion of the receptacle and/or proximate the door or flap 34. The sensors can detect when a play piece enters or exits the receptacle 26 and can generate electrical signals associated with such detection which can be transmitted to the game's control circuitry.

As illustrated in FIG. 1, embodiments of the subject invention can be implemented, for example, in connection with a game having a fish or fishbowl theme where the receptacles 26 are generally shaped or configured to appear like individual fishbowls. According to such embodiments, portions of the electronic display 20 in front of the receptacles 26 can virtually display water, fish or other graphics to give an appearance to a player that the receptacles 26 within the play field 14 are in fact fishbowls containing fish. During play of the game, where an opto-sensor detects that a play piece has entered a receptacle 26, the electronic display 20 can display imagery such as water splashing out of the bowl, the fish jumping up out of the bowl, or any other graphic or video to emphasize or draw the player's attention to the fact that play of the game has resulted in the play piece entering the receptacle 26. It will be generally recognized that such graphics can create a more interactive game experience that can heighten players' interest and enjoyment of the game and over time result in increased play of the game. The electronic display 20 can additionally be programmed to have a standby mode to display interactive or visually stimulating graphics during inactive game periods for purposes of drawing player interest.

The play field can be enclosed by a transparent or translucent cover or liner 36 which can allow players located in front of the machine to see the play field 14 and play pieces moving therein during play of the game. The cover 36 can be located behind the electronic display 20 and in front of the play field 14 and thus be between the play field 14 and electronic display 20 and can prevent and/or protect the electronic display 20 from becoming scratched, cracked or otherwise damaged from play pieces bouncing or deflecting inside the play field 14. The cover 36 (together with the electronic display 20) can additionally retain the play pieces within the play field 14 during play of the game so that they are not projected out of the machine 10. The cover 36 can be affixed to or line the electronic display 20 or can be detached and secured in front of the play field 14 by a door or frame 38 for the electronic display 20.

Figure 6:
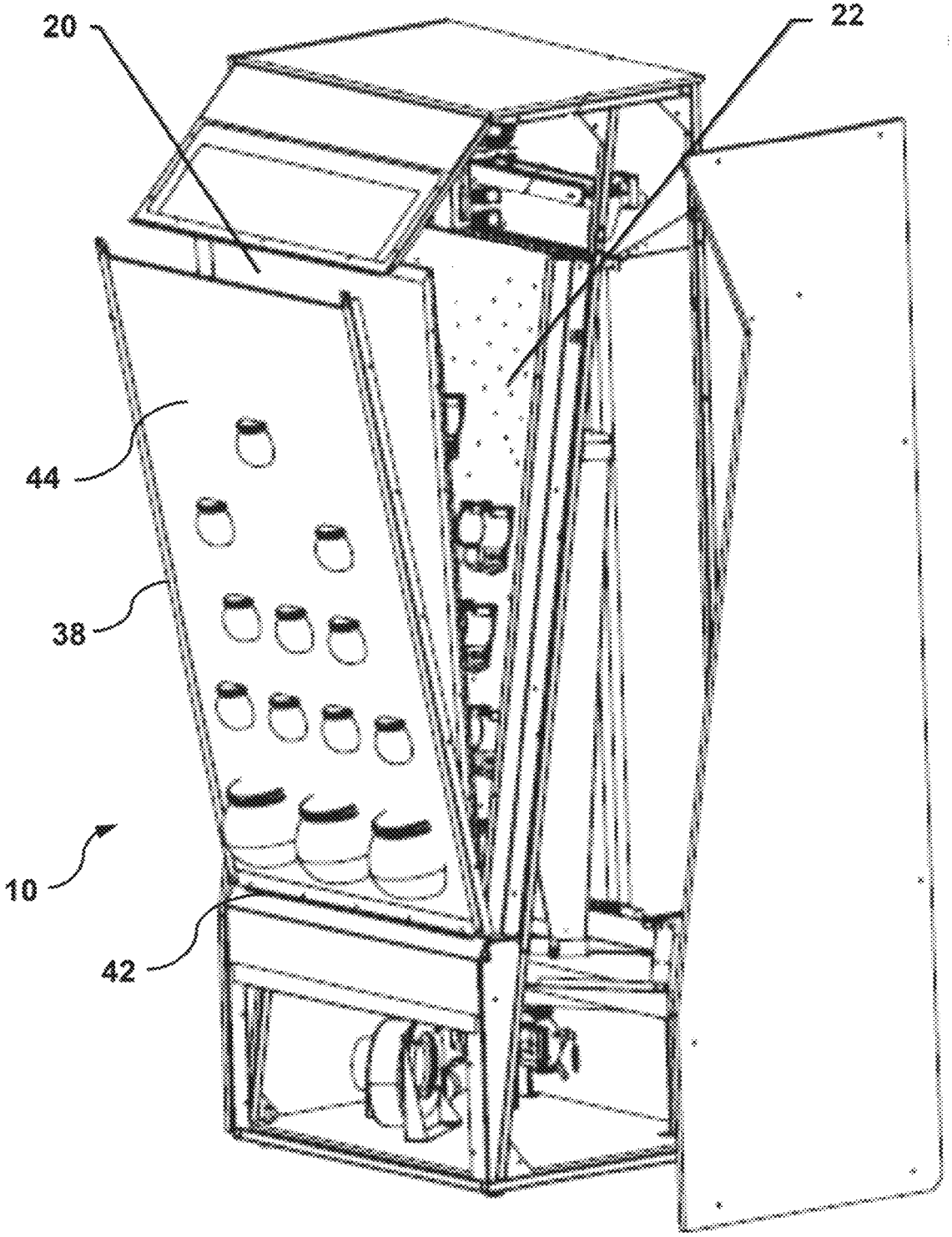
FIG. 6 is a partially exploded perspective view of the game machine with the front of the machine opened and the side and front bottom panels removed.
Figure 9:
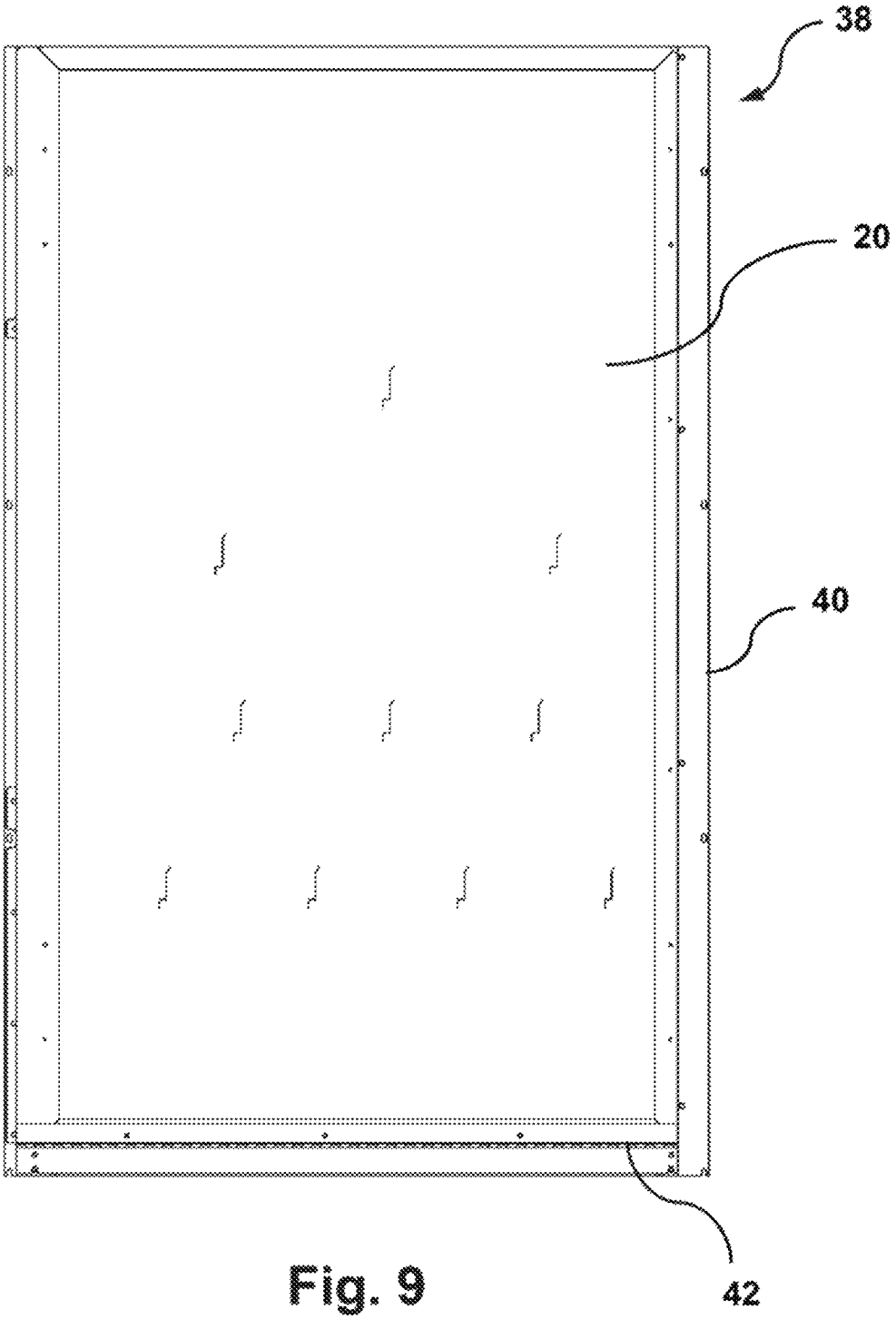
FIG. 9 is a front elevation view of a transmissive electronic display and frame assembly according to embodiments presented herein.
Figure 10:
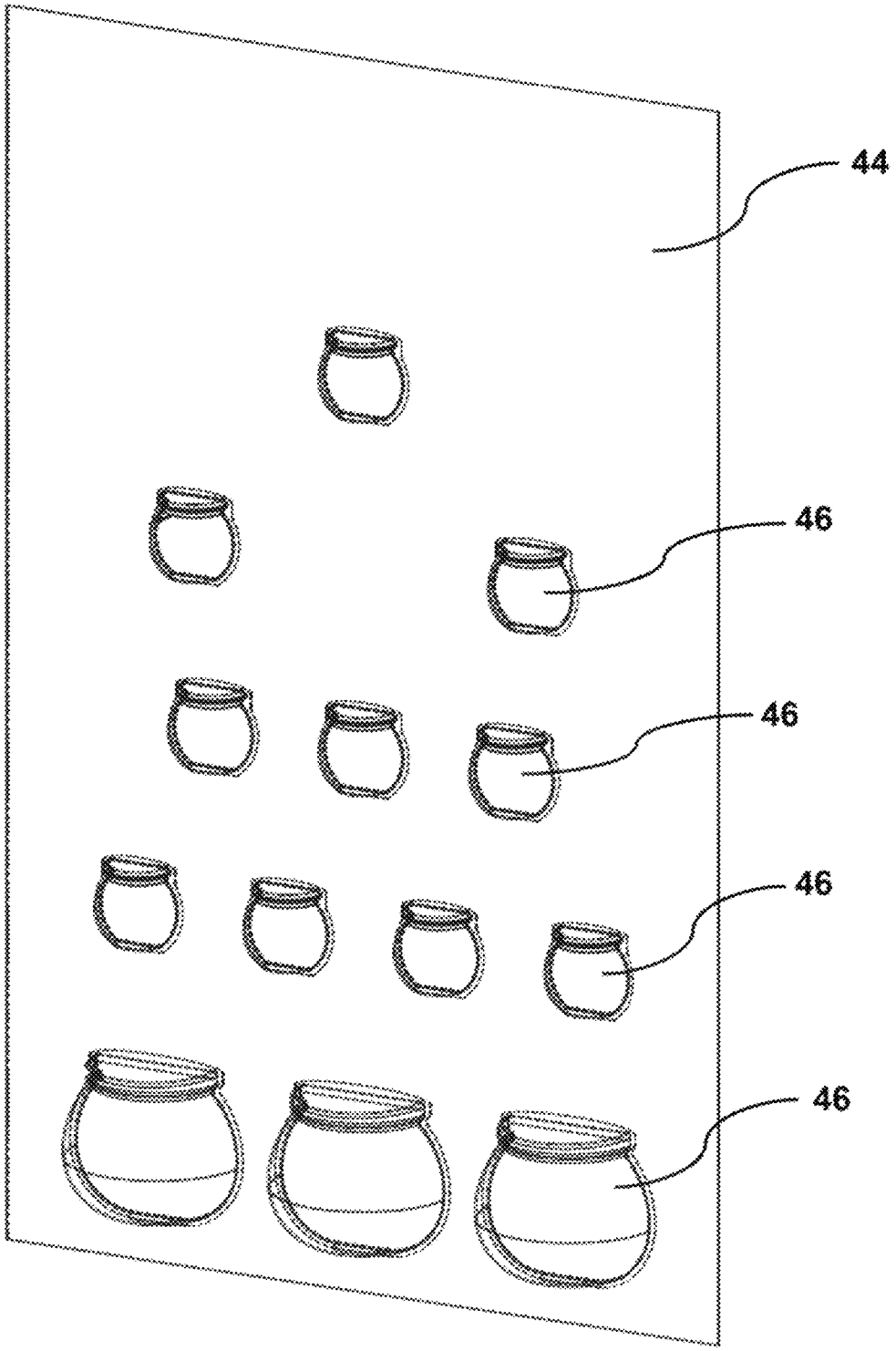
FIG. 10 is a perspective view of an exterior cover according to embodiments presented herein.
Figure 11A:
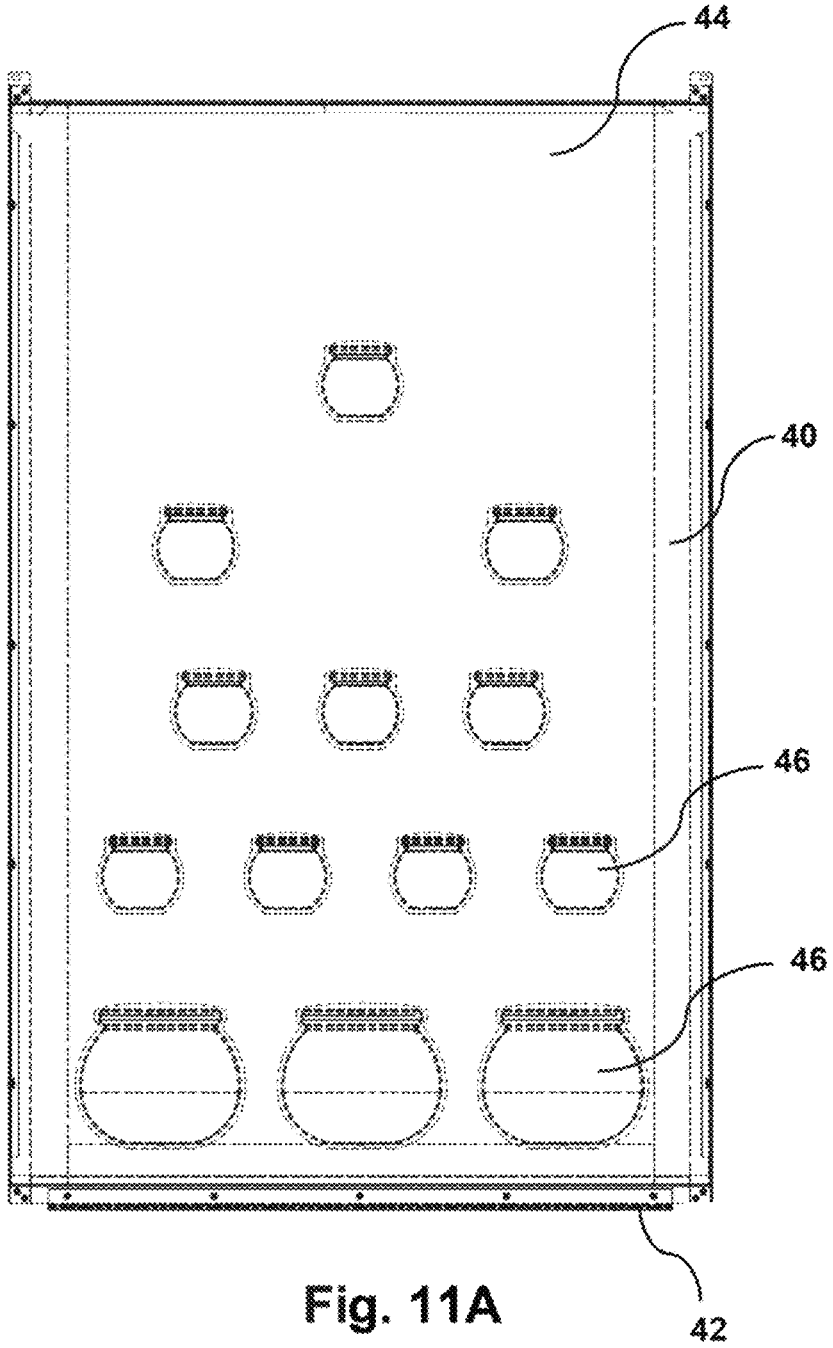
FIG. 11A is a front elevation view of the exterior cover illustrated in FIG. 10 positioned over the transmissive electronic display and frame assembly.
Figure 11B:
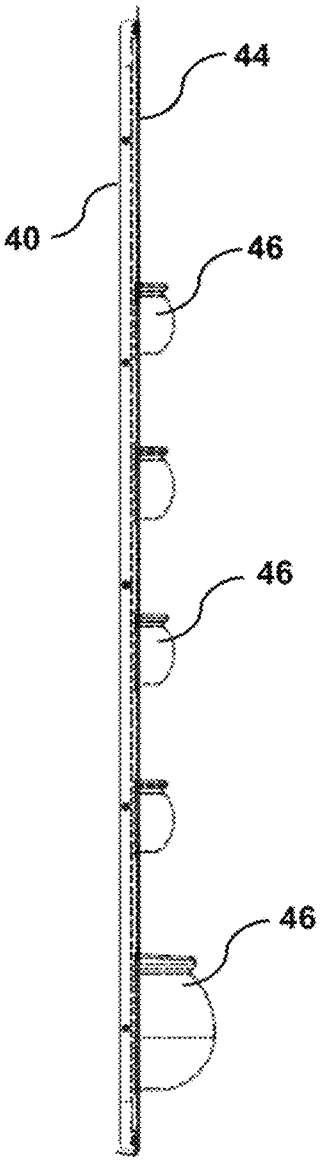
FIG. 11B is a side elevation view of the exterior cover and transmissive electronic display and frame assembly illustrated in FIG. 11A.

FIG. 9 illustrates the door 38 and electronic display 20 according to embodiments of the invention. The door 38 can include an outer frame 40 that can be secured around the perimeter of the electronic display 20. The door 38 can be secured to the cabinet 12 by a hinge 42, joint or fastener which can enable the door to rotate between an open and closed position or otherwise be removable from cabinet 12 in order to provide access to the play field 14 if needed. Although FIGS. 6 and 9 illustrate the hinge 42 being located at the bottom of door 38, persons of ordinary skill in the art will understand that hinge 42 can alternately be positioned along the sides or top of the door 38 to enable the door to rotate horizontally or upwards. The door 38 can additionally include a layer of transparent material, such as glass, plastic or thermoplastic material such as Plexiglas® adjacent the exterior surface of the electronic display 20 to protect it from damage caused by external forces.

The game machine 10 can further include a transparent decorative outer layer or cover 44 comprised of plastic, glass or other material located in front of the electronic display. The outer cover 44 can include outwardly extending decorative projections or features 46 that can be integral with cover 44 and can provide a three-dimensional appearance to game features or elements inside the play field 14. For example, in the fish bowl embodiment described above, the outer cover 44 can include integrally molded semi-spherical fishbowl shaped globes 46 extending outwardly opposite the electronic display 20. Such semi-spherical globes 46 can be arranged so that they can be positioned in front of reciprocals 26 in the play field 14 to make it appear as if the fishbowls are projecting outwardly from the play field 14 in order to give the game more of a realistic appearance to a player.

Figure 12:
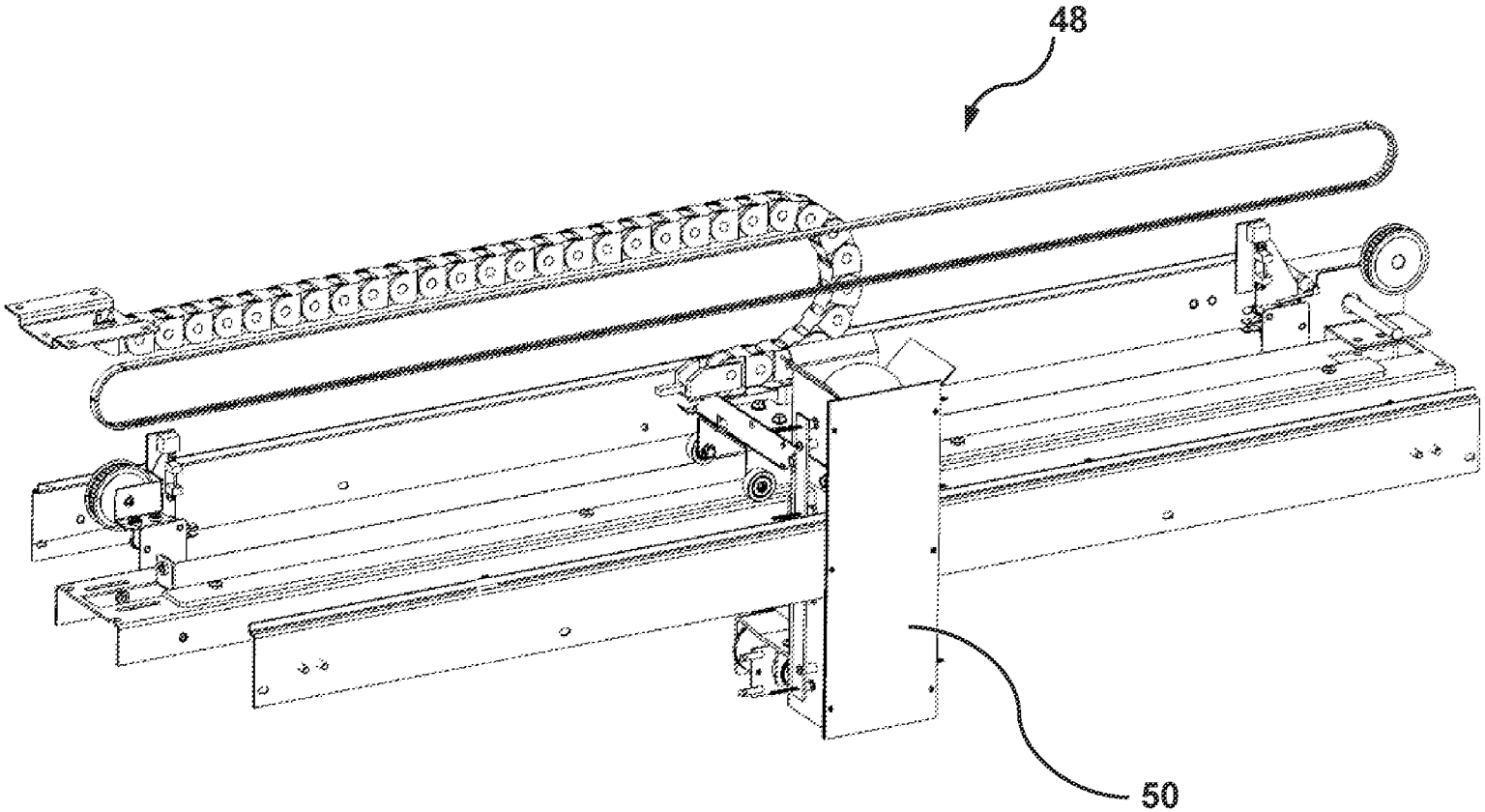
FIG. 12 is a perspective view of a play piece delivery assembly according to embodiments presented herein.

The machine 10 can additionally include an automated delivery device 48 for introducing play pieces or balls into the play field 14. FIG. 12 illustrates an exemplary delivery device 48 according to embodiments of the subject invention. Delivery device 48 can be located near the top of the machine 10 above the play field 14 and can include a release member/assembly 50 that can move in a lateral direction across the top of the play field 14.

Figure 13A:
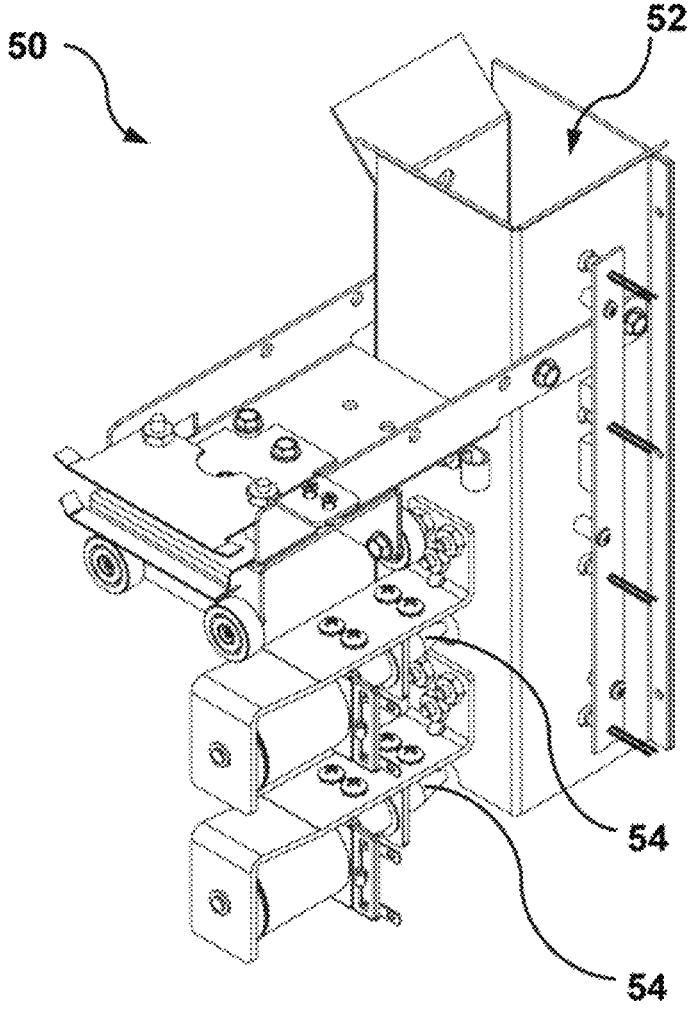
FIG. 13A is a perspective view of a release device of the delivery assembly illustrated in FIG. 12.
Figure 13B:
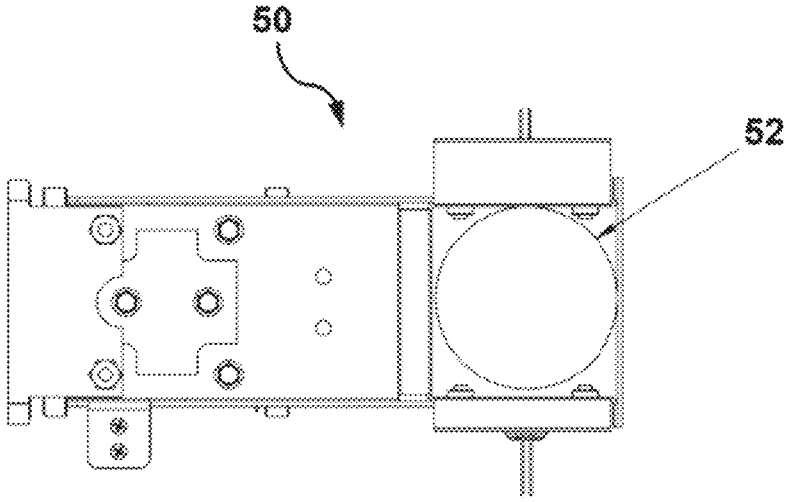
FIG. 13B is a top plan view of the release device illustrated in FIG. 13A.
Figure 13C:
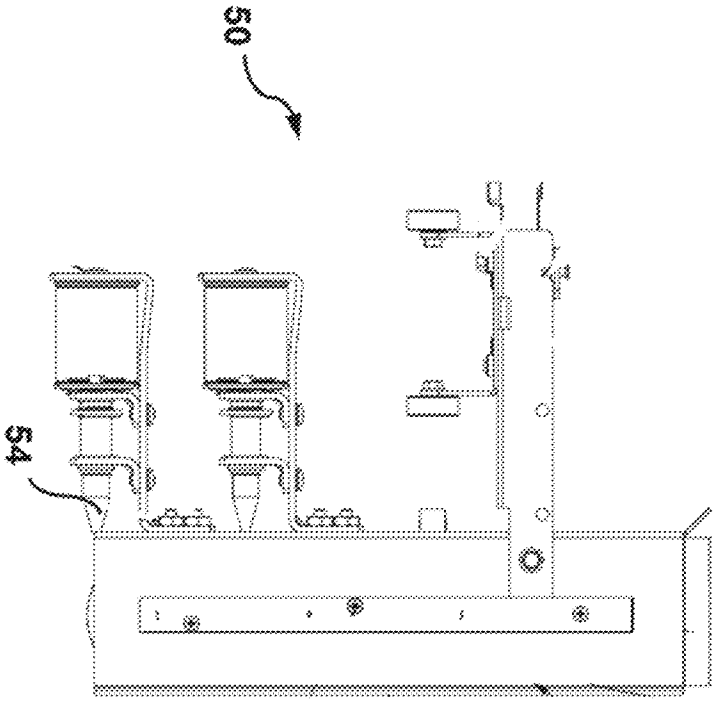
FIG. 13C is a side elevation view of the release device illustrated in FIGS. 13A and 13B.
Figure 14:
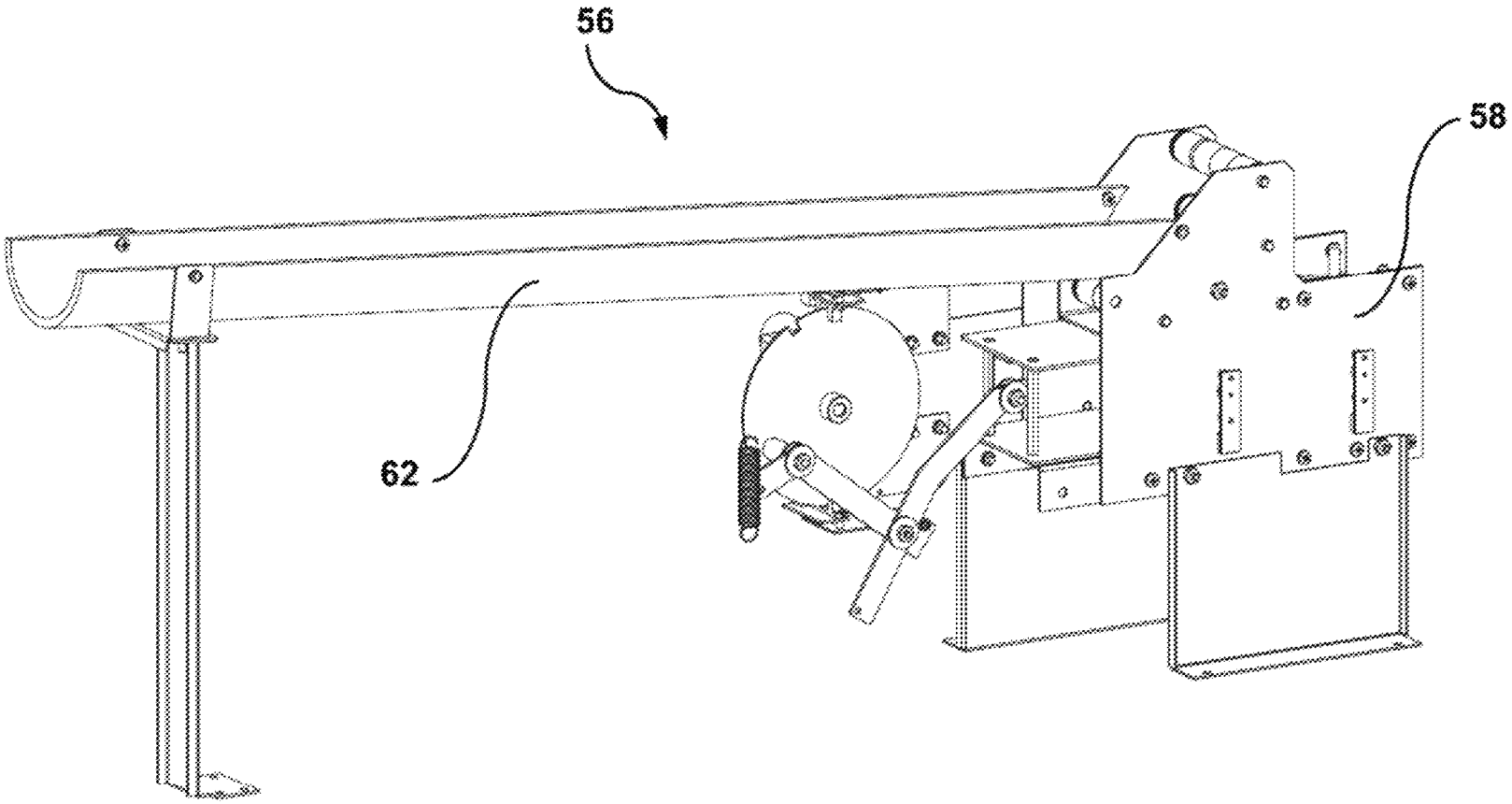
FIG. 14 is a perspective view of a play piece retrieval apparatus according to embodiments presented herein.

FIGS. 13A-13C illustrate an exemplary release member 50 according to embodiments set forth herein. The release member can include an interior compartment or chute 52 for receiving and retaining play pieces before they are introduced into the play field 14 and can also include one or more moveable retention members 54, such as for example, electromechanical solenoids. Retention members 54 can retain play pieces in the interior compartment 52 and can be actuated to retract, recoil, rotate or compress to allow the play piece to exit or fall from the interior compartment 52 into the play field 14 and further advance the next play piece into a release position.

Release member 50 can additionally include rollers, wheels or bearings to enable it to move laterally across the top of the machine 10 and the delivery device 48 can include a complimentary chain, belt, track, and/or drive pulley, cable or wire assembly to further facilitate movement of the release member 50 across the top of the play field 14. During play of the game, lateral movement of release member 50 across the top of the play field 14 can be can be automatically controlled by the game or manually controlled by a player. It is preferred, however, that the game allow a player to activate retention members 54 of the release device 50 in order to control where the play piece is deposited into the play field 14 to provide the element of skill in gameplay.

According to embodiments set forth herein, the game machine 10 can further include an automated play piece retrieval apparatus or assembly 56 which can collect play pieces that have exited the play field 14 and return them to the delivery device 48 for successive play. FIGS. 13A-13C illustrate an exemplary retrieval apparatus 56 according to embodiments presented herein. The retrieval apparatus 56 can be located proximate the bottom of machine 10, below or near the bottom of play field 14. Retrieval apparatus 56 can include a motorized loading mechanism 58 for positioning play pieces in a sealed tube 60 (see FIG. 4) or onto a mechanical conveyer assembly (not shown) extending upwards within the machine 10 to delivery device 48 at the top of play field 14. Where a sealed tube 60 is provided, the retrieval assembly 56 can include an air blower which can introduce air into the tube 60 to propel the play pieces upward to the delivery device 48. The retrieval device can additionally include one or more chutes, channels, gutters and/or rollers 62 to facilitate the delivery or routing of the play pieces into the loading mechanism 58.

The electrical and mechanical components of the game machine, including the play field 14, light source 16, delivery device 48 and retrieval apparatus 56 can be contained within the cabinet 12. Cabinet 12 can have a substantially upright orientation and can be comprised of wood, plywood, metal or other sturdy rigid material. The exterior of cabinet 12 can further be adorned with artwork, graphics or decorative features representative of the theme of the game. The machine 10 can additionally include exterior lighting elements, audio transducers for playing music or audio effects, or visual displays, including for example, LED lights, electroluminescent game toppers, backlit lighting displays or windows for holding a translucent panel with static imagery, or supplemental electronic display(s) for presenting dynamic information and images including scoring, advertising or promotions or other game-related information.

Figure 15:
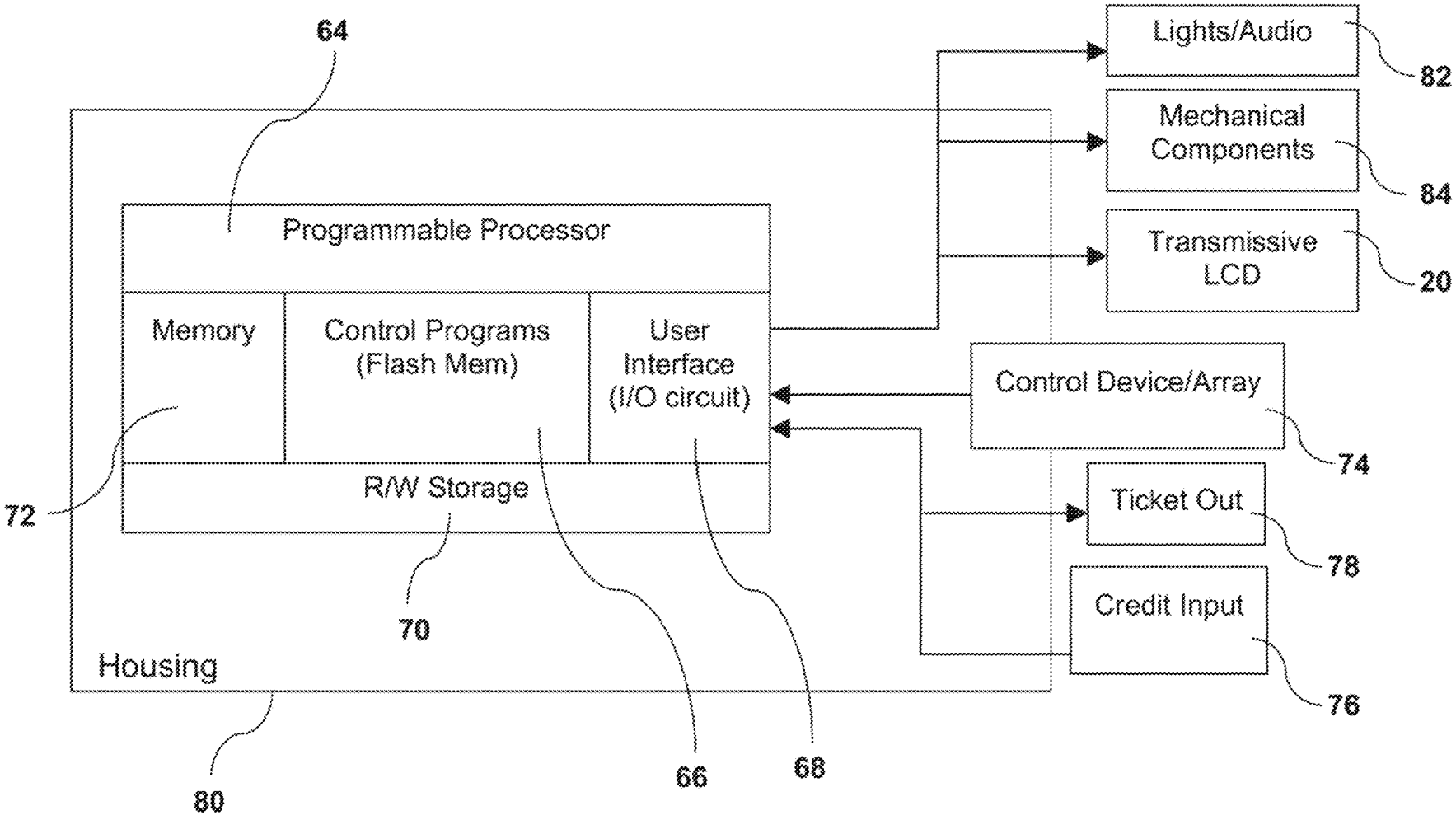
FIG. 15 is a block diagram illustrating a representational view of electronic elements of a game machine according to embodiments of the subject invention.

FIG. 15 is a block diagram illustrating a representational view of electronic components of machine 10. Such components can operate the game including the mechanical components 84 and electronic display device 20. Generally, machine 10 can include a programmable processor 64 (such as for example a microprocessor or microcontroller) including control programs and associated circuitry 66, a user interface 68 including an input/output ("I/O") board or circuits and at least one storage unit 70 which can store a plurality of computer-readable instructions or programs executable by processor 64. Processor 64 can also include electronic memory 72, including random-access memory (RAM) modules containing dynamic information processed during operation of the game and/or a static read-only memory (ROM) which can contain fixed information, such as, for example, an operating system and game programs which can control the electronic display 20.

The user interface 68 and I/O circuits can be connected to a player control mechanism or array 74, including, for example a button, mechanical lever, joystick or touch screen. The game machine 10 can additionally include a credit input device 76, such as a coin slot, bill acceptor or card reader and a disbursement device 78, such as a ticket dispenser. The credit input device 76 and disbursement device 78 can be operatively connected to the processor 64, and when money or other credits are required and deposited for play of the game, the control program can instruct the disbursement device to issue an award where a predetermined winning outcome has been detected. The reward or disbursement can be provided in any form, including for example, tickets, coupons, game points or credits, additional plays or bonus game modes.

The electronic components illustrated in FIG. 15 can be located within a control cabinet or housing 80 which can be part of the same cabinet 12 housing the play field 14 and light source 16 or a separate cabinet physically or operatively connected thereto. The control cabinet 80 can similarly feature lighting devices, audio transducers 82 and/or artwork of the type previously described.

The game program can associate certain game events as predetermined winning outcomes and can further provide and establish prize values associated with winning outcomes. For example, a winning outcome can be associated with a play piece falling into a receptacle 26 in the play field 14. Further, where multiple receptacles 26 are provided at different locations on the play field 14, the game can associate different prize values for different receptacles 26. Such assignment of prize values can be based on the particular location of the receptacle 26 on the play field 14, with greater prize values being associated with receptacles 26 that are positioned in locations in which it is more difficult or unlikely for play pieces to enter.

The game can further allow an operator to set or control the prize values to a desired amount and can provide for varying or alternating prize values during the course of a game depending on the triggering of a predetermined game event. Such triggering event can include obtaining a certain predetermined number of winning outcomes, playing a certain predetermined number of games, obtaining a certain number or winning outcomes in a particular time period, or playing a certain number of games in a predetermined time period. Further, prize values can be a number of tickets to be provided to the player, and/or extra plays or bonus games, including for example, a multiple play piece game mode ("multi-ball") in which a plurality of play pieces can be delivered into the play field in rapid succession.

In carrying out a game played on machine 10, embodiments presented herein can accept a game credit, and where the amount of credit matches or exceeds a predetermined threshold, the game can execute the game program to initiate play of the game. In initiating play, the player control mechanism 74 can be activated to accept input from a player and the processor 64 can control the electronic device 20 to display predetermined game imagery. The play piece delivery device 48 can also be activated to move across the top of the play field 14, and in response to input received from the control mechanism 74, the release member 50 can be actuated to release a play piece into the play field 14.

During the game, a play piece can fall downwardly though the play field 14 and where the play piece falls into a receptacle 26, the opto-sensor can detect such occurrence and provide a signal to the processor 64 that such event has occurred. Processor 64 can in turn register such event and, where such event is associated with a predetermined winning or non-winning outcome, the processor 64 can generate a signal to implement predetermined sensory effect(s). Such sensory effects can include, for example, special graphics displayed on the electronic display 20, music or sounds emitted by the audio transducer(s) 82, illumination of lighting elements or special lighting patterns, or any other sensory effect capable of alerting a player that a predetermined game outcome has occurred. It will be further understood that any such sensory effects can be generated automatically without requiring a particular game action or result.

Where a predetermined winning outcome has been registered by the processor 64, the processor 64 can additionally instruct the game to provide a predetermined reward. The reward can be the implementation of a bonus game, such as "multi-ball" mode as described previously, or the generation of an award by the disbursement device 78, such as the issuance of tickets.

Upon a play piece exiting the play field 14, either through the back of a receptacle 26 or through the bottom or the play field 14, an opto-sensor can detect such activity and send a signal to the processor 64 which can activate the retrieval apparatus 56 to return the play piece to the delivery device 48 for successive play.

It will be understood by persons of ordinary skill in the art that embodiments of the subject invention, and particularly use of a transmissive electronic display panel 20 overlaying a mechanical play field 14, can be incorporated into other game formats or variations of game machines without departing from the scope of the subject invention. For example, such embodiments can be practiced on games without pins, pegs, ridges or raised shapes. Such games can further include gravity-activated game pieces which fall top to bottom as described above, or game pieces projected vertically or horizontally using mechanical devices such as motors, solenoids or springs. In addition, such games can include additional player control elements such as flippers, gates or shooters that can manipulate the game piece within the play field.

As an example, embodiments disclosed herein can be practiced in connection with a game where the playfield and LCD are horizontal. Such a game can entail two opposing players (e.g., a pitcher and a batter in a baseball-themed game) each on opposite sides of the LCD. One player can mechanically and electronically control the pitcher in order to propel a ball toward the batter. The second player can mechanically and electronically control the batter. Such game can allow the players to view the ball park on the transmissive LCD and see the actual ball being pitched and hit below the LCD. Once the ball is hit, electronic targets on the playfield can be activated by the ball and cause animated players on the transmissive LCD to make the appropriate play.

Thus, from the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims and all such modifications as fall within the scope of the claims.

What is claimed is:

1. A game machine comprising:

a play field having a top and bottom and an internal translucent back panel having first and second sides;

a receptacle along the first side of the translucent back panel, the receptacle having an open top, a closed bottom and a detection element, at least a portion of the receptacle being positioned over a door on the back panel, the receptacle configured to enable a play piece entering the receptacle to exit the play field through the door;

a light source located adjacent the second side of the translucent back panel, the translucent back panel being located between the light source and the play field, and a transmissive electronic display covering at least a portion of the play field opposite the translucent back panel, the display being illuminated by the light source to present virtual images over the play field in response to detection of the play piece at a location inside the play field during play of a game on the game machine, light from the light source being directed through the play field onto the transmissive electronic display to enable visual presentation of the virtual images on the transmissive electronic display, such virtual images being superimposed over the play field to create virtual visual effects in association with a game played within the play field behind the transmissive electronic display; and a transparent cover enclosing the play field, the cover being located between the first side of the play field and the electronic display, wherein at least some of the virtual images presented on the transmissive electronic display are graphics exhibited in response to signals generated by the detection element on the receptacle as the play piece is collected for exit from the play field, the play field continuing to be visible through the graphics exhibited in response to detection of the play piece exiting the play field through the receptacle.

2. The game machine of claim 1 further comprising a cabinet housing the play field and light source.

3. The game machine of claim 1 where the play field has a deflection member, the deflection member being between the transmissive electronic display and the first side of the translucent back panel.

4. The game machine of claim 3 where the defection member is secured to the first side of the translucent back panel.

5. The game machine of claim 1 further comprising a play piece delivery device located along the top of the play field, the play piece delivery device having a holding compartment and a movable retaining member, the retaining member releasably holding the play piece in the holding compartment to prevent the play piece from falling into the play field below the play piece delivery device.

6. The game machine of claim 5 where the play piece delivery device is moveable in a lateral direction across the top of the play field.

7. The game machine of claim 5 further comprising a play piece retrieval apparatus, upon exit of the play piece from the play field through either the receptacle or the bottom of the play field the play piece being collected by the retrieval apparatus and returned to the delivery device.

8. The game machine of claim 5 further comprising a user input device, the user input device comprising at least one of a lever, button, joystick or touch screen, movement of the play piece delivery device and the retaining member being controllable by the user input device.

9. The game machine of claim 1 where the cover can be opened or removed from a cabinet housing the play field.

10. The game machine of claim 1 where the transmissive electronic display is a translucent flat panel liquid crystal display screen.

11. The game machine of claim 1 further comprising a programmable processor, control circuitry and instructions stored on a computer readable medium, the instructions being executable by the processor in response to input received from a control mechanism, the processor and control circuitry receiving input from sensors and in response thereto controlling the presentation of images on the transmissive electronic display.

12. The game machine of claim 1 where the detection element comprises at least one of a sensor or electronic switch, the play piece entering the receptacle being detected by the detection element.

13. The game machine of claim 1 further comprising an exterior cover over the electronic display, the electronic display being between the exterior cover and the play field, at least a portion of the exterior cover being transparent, the exterior cover having an integral projection extending outwardly therefrom and away from the underlying electronic display.

14. The game machine of claim 1 further comprising the play piece, the play piece comprising at least one of a ball, disk, token, coin or pellet, the play piece being sized and shaped to move along the play field.

15. The game machine of claim 1 where the light source comprises at least one of an electric lamp, electric lighting element, light emitting diode, fluorescent light, neon light, halogen light or incandescent light.

16. A method of play of a game machine comprising:

providing a gaming machine having a play field with a top and bottom and an internal translucent back panel having first and second sides, a receptacle along the first side of the translucent back panel, the receptacle having an open top, a closed bottom and a detection element, at least a portion of the receptacle being positioned over a door on the back panel, the receptacle configured to enable a play piece entering the receptacle to exit the play field through the door, a light source located adjacent the second side of the back panel, the back panel being located between the light source and the play field, a transmissive electronic display covering at least a portion of the play field opposite the back panel, and a transparent cover enclosing the play field, the transparent cover being located between the first side of the play field and the electronic display;

illuminating the electronic display through the back panel from the light source, light from the light source being directed through the play field onto the transmissive electronic display;

accepting input to begin a game;

releasing a play piece into the play field from the top of the play field;

allowing the play piece to descend under the force of gravity downward through the play field along the first side of the back panel;

receiving the play piece into the receptacle;

detecting the play piece being collected by the receptacle for exit from the play field;

transmitting an electronic signal to a programmable processor;

electronically processing the signal according to predetermined rules of the game;

displaying virtual images electronically on the transmissive electronic display in response to detection of the collection of the play piece by the receptacle, the light source enabling visual presentation of the virtual images on the transmissive electronic display, the virtual images being superimposed on the playfield to create an visual effects in association with the game, at least some of the virtual images presented on the transmissive electronic display are graphics exhibited in response to signals generated by the detection element on the receptacle as the play piece is collected for exit from the play field, the play field continuing to be visible through the graphics exhibited in response to detection of the play piece exiting the play field through the receptacle, and returning the play piece to a delivery device proximate the top of the play field.

17. The method of claim 16 further comprising accepting payment prior to releasing a play piece.

18. The method of claim 16 further comprising issuing an award in the form of at least one of tickets, coupons, tokens, credits, points, toys or bonus plays.

19. The method of claim 18 further comprising establishing awards of different predetermined values, an award value assigned to a receptacle proximate the bottom of the play field having a greater value than an award value assigned to a receptacle proximate the top of the play field.

20. The method of claim 16 further comprising initiating a multiple play piece game mode by releasing a plurality of play pieces into the play field in rapid succession.

* * * * *